US009534444B2

(12) United States Patent
Kraft et al.

(10) Patent No.: US 9,534,444 B2
(45) Date of Patent: Jan. 3, 2017

(54) DOWN-THE-HOLE HAMMER DRILL BIT ASSEMBLY

(71) Applicant: SANDVIK INTELLECTUAL PROPERTY AB, Sandviken (SE)

(72) Inventors: Conny Kraft, Sandviken (SE); Anna Nordstrand, Gavle (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/037,092

(22) PCT Filed: Nov. 10, 2014

(86) PCT No.: PCT/EP2014/074125
§ 371 (c)(1),
(2) Date: May 17, 2016

(87) PCT Pub. No.: WO2015/071203
PCT Pub. Date: May 21, 2015

(65) Prior Publication Data

US 2016/0298390 A1 Oct. 13, 2016

(30) Foreign Application Priority Data

Nov. 18, 2013 (EP) ..... 13193303

(51) Int. Cl.
*E21B 4/14* (2006.01)
*E21B 1/00* (2006.01)
*E21B 10/36* (2006.01)
*E21B 34/06* (2006.01)

(52) U.S. Cl.
CPC . *E21B 4/14* (2013.01); *E21B 1/00* (2013.01); *E21B 10/36* (2013.01); *E21B 34/06* (2013.01)

(58) Field of Classification Search
CPC combination set(s) only.
See application file for complete search history.

(56) References Cited

U.S. PATENT DOCUMENTS

| | | | |
|---|---|---|---|
| 4,278,135 | A | 7/1981 | Curlington |
| 6,125,952 | A | 10/2000 | Beccu et al. |
| 2010/0193208 | A1 | 8/2010 | Plunkett |
| 2011/0232922 | A1 | 9/2011 | Yao et al. |

FOREIGN PATENT DOCUMENTS

| | | | |
|---|---|---|---|
| WO | 0011219 | A1 | 5/1980 |
| WO | 97/00371 | A1 | 1/1997 |
| WO | 2006116646 | A2 | 11/2006 |
| WO | 2008051132 | A1 | 5/2008 |
| WO | 2013104470 | A2 | 7/2013 |

*Primary Examiner* — David Andrews
*Assistant Examiner* — Ronald Runyan
(74) *Attorney, Agent, or Firm* — Corinne R. Gorski

(57) ABSTRACT

A down-the-hole hammer drill bit assembly includes a foot valve and a drill component having respective abutment regions in the form of cooperating lugs and shoulders that may be engaged by rotation of the valve relative to the drill bit component to allow the lugs and shoulders to overlap radially to lock the valve at the drill component. The assembly is advantageous to allow coupling and decoupling on-site without the need for specific swaging or hydraulic/pneumatic assembly tools.

13 Claims, 8 Drawing Sheets

DOWN-THE-HOLE HAMMER DRILL BIT ASSEMBLY

RELATED APPLICATION DATA

This application is a §371 National Stage Application of PCT International Application No. PCT/EP2014/074125 filed Nov. 10, 2014 claiming priority of EP Application No. 13193303.8, filed Nov. 11, 2013.

FIELD OF INVENTION

The present invention relates to a down-the-hole hammer drill bit assembly and in particular, although not exclusively, to a drill bit assembly in which a foot valve is releasably secured to a shank portion of a drill bit so as to greatly facilitate insertion and removal of the valve at the assembly.

BACKGROUND ART

The technique of down-the-hole (DTH) percussive hammer drilling involves the supply of a pressurised fluid via a drill string to a drill bit located at the bottom of a bore hole. The fluid acts to both drive the hammer drilling action and to flush rearwardly dust and fines resultant from the cutting action, rearwardly through the bore hole so as to optimise forward cutting.

Typically, the drill assembly comprises a casing extending between a top sub and a drill bit. A piston is capable of shuttling axially between the top sub and the drill bit and is driven by the pressurised fluid so as to be configured to strike a rearward anvil end of the bit to provide the percussive action. A foot valve extends axially rearward from the drill bit to mate with the piston during its forwardmost stroke to control both the return stroke and provide exhaust of the pressurised fluid from the drill head which act to flush rearwardly the material cut from the bore face. Example DTH hammer drills are described in U.S. Pat. No. 4,278,135; U.S. Pat. No. 6,125,952, WO 97/00371; WO 2006/116646; WO 2008/051132 and WO 2013/104470.

The foot valve is repeatedly contacted by the reciprocating piston and is positioned at the region of contact between the piston and an anvil surface of the drill shank. Accordingly, the foot valve is subjected to mechanical and thermal stress and abrasion wear within the drill assembly that limits its operational lifetime. To replace the foot valve, it is necessary to extract the entire length of drill string loaded down the bore hole which is a time consuming exercise and is expensive due to lost drilling. US 2011/0232922 describes a variety of different foot valve embodiments in an attempt to maximise the service life of the valve to mitigate premature detachment of all or part of the valve during use. However, conventional foot valves and DTH drill assemblies are disadvantageous for a number of reasons. Typically, the foot valve is swaged or press-fitted into the drill bit shank which necessitates a mechanical or pneumatic/hydraulic press that is not typically available on-site. Additionally, and following use or damage, removal of conventional foot valves is difficult and time consuming adding to drilling downtime. For example, it is not uncommon for operators, on-site to continue installation and use of a foot valve that has been damaged during transportation or initial assembly as firstly it is difficult to remove the valve and secondly the time delay with returning the foot valve and assembly to the initial swaging press (commonly at a different location) is undesirable. Accordingly, what is required is a foot valve and/or drill assembly that addresses the above problems.

SUMMARY OF THE INVENTION

It is an objective of the present invention to provide a down-the-hole (DTH) hammer drill bit assembly in which a foot valve is capable of being mated and decoupled from a drill bit shank quickly and conveniently without the need for auxiliary press and extraction apparatus and tools. Accordingly, it is a specific objective to provide a foot valve and drill assembly that may be connected and disconnected on-site using standard, non-specialist tools. It is a further objective to provide a foot valve and drill bit assembly that are i) releasably connected together to withstand both mechanical and thermal stresses in use, ii) configured to maximise the lifetime of the foot valve and iii) to minimise the likelihood of shear, fracture or detachment of the foot valve at the drill bit shank during use.

The objectives are achieved by providing a foot valve and a drill component having respective abutment regions in the form of cooperating lugs and shoulders that may be engaged by rotation of the foot valve relative to the drill bit component such that the lugs and shoulders overlap radially to lock the valve at the drill component to prevent undesirable axial separation of the valve from the drill component.

In particular, the lugs and shoulders are formed as circumferentially spaced apart 'raised' regions that are discontinuous in a circumferential direction around the valve and the drill components. In particular, and in one embodiment, the shoulders extend radially inward within an axial passageway of the drill shaft to cooperate with radially outward extending lugs provided at the valve. The circumferential separation distance between the shoulders and a circumferential length of each lug is configured such that the lugs may slide axially between the shoulders during initial installation and eventual decoupling. During installation, once the lugs are fitted past the shoulders, the valve may be rotated simply so as to lock the lugs axially underneath the shoulders and prevent axial separation via friction fit and abutment contact between the two components.

Accordingly, the lugs and shoulders are shaped and profiled specifically to optimise the ease of assembly and disassembly whilst providing a robust couple between the components that is not susceptible to decoupling during use. In particular, the present valve and assembly may be readily coupled and decoupled by on-site personnel via an appropriate twist and axial pulling/pushing action.

According to a first aspect of the present invention there is provided a down-the-hole hammer drill bit assembly comprising: a drill bit having a forward cutting end and rearward anvil end, an internal passageway extending along a longitudinal axis of the assembly from the anvil end towards the cutting end; a foot valve seated partially within the passageway to extend axially from the anvil end; complementary abutment regions provided respectively at a radially inward facing surface of the passageway and a radially outward facing surface of the foot valve, the respective abutment regions configured to abut one another and axially lock the foot valve to the drill bit; characterised in that: the abutment regions comprise: a plurality of radially projecting lugs spaced apart in a circumferential direction around the axis; and a plurality of radially extending shoulders spaced apart in a circumferential direction around the axis; a circumferential separation distance between the shoulders is at least equal to or greater than a circumferential length of the lugs to allow the lugs to pass axially between the shoulders without substantially deforming the foot valve radially; an axially rearward end of each lug is tapered radially to provide an abutment contact surface and an axially forward end of each shoulder is tapered radially to provide an abutment contact surface; wherein a radial length of the lugs and shoulders are configured such that with the lugs positioned axially beyond the shoulders the abutment contact surfaces of the lugs and shoulders mate together to overlap radially within the passageway and provide friction fit regions that axially lock and inhibit independent rotation of the foot valve at the drill bit.

Preferably, the lugs are positioned at the same axial position relative to one another and the shoulders are positioned at the same axial position relative to one another.

Preferably, the assembly comprises three lugs and three shoulders. The lugs and shoulders are defined as respective raised humps, bumps or projections extending radially at the respective surface of the foot valve and passageway of the drill bit. The lugs and shoulders present an optimised configuration to prevent any lateral movement of the valve at the drill bit whilst minimising the amount of additional material and therefore weight of the components associated with the lugs and shoulders.

Reference within the specification to a 'drill bit' encompass the drill component having a drill head that mounts the cutting bits or buttons and an axially extending shank or shaft that projects rearwardly from the drill head.

Optionally, each lug and shoulder may be formed as a discrete raised bump on the respective valve or passageway surface. Alternatively, the raised bump may represent a tip or end region of a raised projection having a larger cross sectional area. A discrete radially extending lug and shoulder is advantageous to provide the radial overlap required for axial locking whilst minimising the volume of material of the component.

Optionally, the abutment contact surface of each lug is tapered radially to provide an inclined contact surface and the abutment contact surface of each shoulder is tapered radially to provide a declined contact surface such that the inclined and declined surfaces are complementary to mate together via overlapping contact. The inclined and declined contact surfaces are advantageous to maximise the contact area between the respective valve and drill bit. Such a configuration is advantageous to provide a secure axial lock and to provide a friction-fit upon rotation of the valve within the passageway.

Preferably, each lug and each shoulder is defined, in part, by a pair of respective lengthwise side surfaces tapered radially such that each lug and each shoulder is formed by a smooth transition with the respective surface of the foot valve and the passageway. Such an arrangement is advantageous to facilitate both coupling and decoupling of the valve at the drill bit and to account for manufacturing tolerances and thermal expansion and contraction of the components that may otherwise prevent or inhibit coupling and decoupling of the valve.

Preferably, the lugs and shoulders are positioned axially closest to the anvil end relative to the cutting end. This is advantageous to provide a secure axial lock and to minimise the length of the foot valve embedded within the passageway without compromising the strength of the axial lock and axial alignment of the valve at the drill bit.

Optionally, the valve and/or passageway surface may be radially tapered in the circumferential direction to friction fit the foot valve at the drill bit on rotation of the foot valve at the drill bit. Such an arrangement is advantageous to rotatably lock the valve at the drill bit such that personnel are provided with a degree of 'feel' when coupling and decoupling the valve at the drill bit. The present friction fitting configuration also prevents undesirable independent rotation of the valve at the drill bit during use.

Preferably, the foot valve comprises a plastic material and the drill bit comprises a metal or metal alloy material. Preferably, the valve comprises a polyamide.

Preferably, the lugs project radially outward from the surface of the foot valve and the shoulders extend radially inward from the surface of the passageway. Preferably, the lugs comprise an axial length greater than a circumferential length. Optionally, the lugs comprise a generally rectangular shaped profile when the valve is viewed from its axial side.

Optionally, within a lengthwise region of the foot valve configured to be positioned within the passageway, the lugs represent a radially outermost part of the foot valve; and within a lengthwise region of the drill bit configured for mating opposed to the foot valve, the shoulders represent a radially innermost part of the passageway. Such a configuration is advantageous to optimise the axial locking of the valve at the drill bit via maximising the radial overlap of the lugs and shoulders. Additionally, this configuration is beneficial for ease of insertion and withdrawal of the valve at the passageway and to avoid other regions of the valve and passageway contacting or abutting unintentionally that may inhibit axial and rotational movement of the valve relative to the drill bit.

Preferably, the foot valve comprises a first length section and a second length section, the second length section having a larger outside diameter relative to the first length section, the lugs positioned within the second length section. The relative radial sizes of the first and second length sections ensure the valves is as stable as possible within the passageway (via a larger outside diameter) whilst the first length section of smaller outside diameter is compatible for mating with the forward end of the piston. Optionally, the foot valve comprises an annular collar extending radially outward beyond the second length section and positioned axially at the junction between the first and second length sections. During coupling, the collar acts to limit the axial advancement of the valve into the passageway to determine the correct axial positioning of the lugs relative to the shoulders immediately prior to rotation of the valve relative to the drill bit that provides the axial lock.

According to a second aspect of the present invention there is provided a down-the-hole hammer for percussive rock drilling comprising an assembly as claimed herein.

According to a third aspect of the present invention there is provided a down-the-hole drill bit foot valve configured to form part of a drill assembly and for releasable coupling to a drill bit and in particular a drill bit shaft, the foot valve comprising a plurality of radially projecting lugs spaced apart in a circumferential direction around an axis of the valve at the same axial position, the lugs having a circumferential length configured to allow coupling and decoupling from the drill bit via a two stage motion involving an axial displacement of the valve relative to the drill bit and a rotation about a central longitudinal axis of the valve relative to the drill bit.

According to a fourth aspect of the present invention there is provided a drill bit having a drill head and a rearwardly extending shaft having a plurality of radially inward extending shoulders distributed circumferentially around the surface of an internal passageway extending axially through the drill bit.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
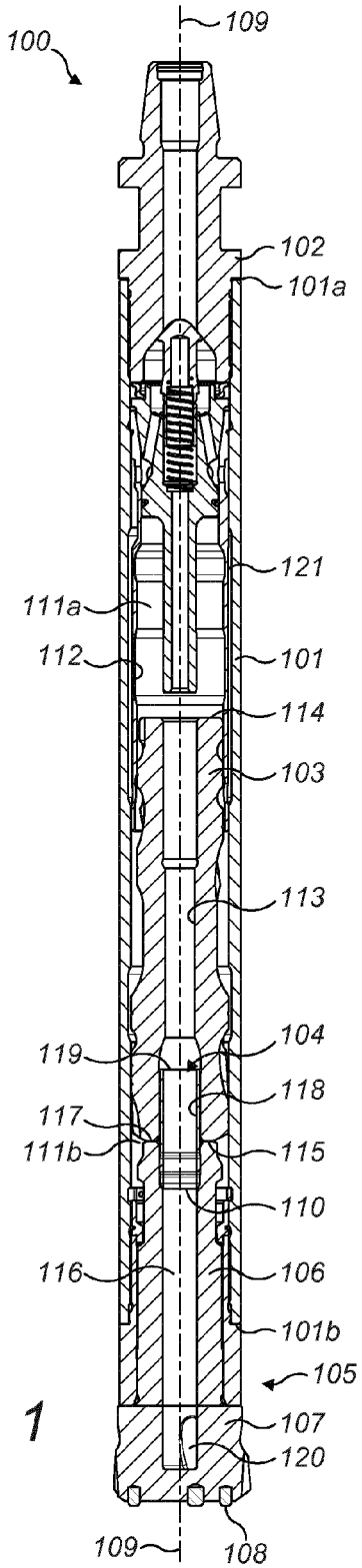
FIG. 1 is an axial cross sectional view of a down-the-hole hammer drill assembly according to a specific implementation of the specific invention.

Referring to FIG. 1, a down-the-hole (DTH) hammer drill assembly 100 comprises a substantially hollow cylindrical casing 101 having an axially rearward end 101*a* and an axially forward end 101*b*. A top sub 102 is at least partially accommodated within rearward end 101*a* of casing 101 whilst a drill bit 105 is at least partially accommodated within the casing forward end 101*b*. Drill bit 105 comprises an elongate shaft 106 having internal passageway 116. A drill bit head 107 is provided at a forward end of shaft 106 and comprises a plurality of wear resistant cutting buttons 108. An axially rearward face 117 of shaft 106 represents an anvil end of drill bit 105.

A distributor cylinder 121 extends axially within casing 101 and in contact with an inward facing substantially cylindrical casing surface 112 that defines an axially extending internal cavity. An elongate substantially cylindrical piston 103 extends axially within cylinder 121 and casing 101 and is capable of shuttling back and forth along central longitudinal axis 109 extending through the assembly 100. Piston 103 comprises an axially rearward end 114 and an axially forward end 115. An internal bore 113 extends axially between ends 114, 115.

A foot valve 104 projects axially rearward from the anvil end of drill bit shaft 106 and comprises a generally cylindrical configuration having a rearward end 119 and a forward end 110. An external passageway 118 extends axially between ends 119, 110 in fluid communication with drill bit passageway 116 and piston passageway 113. In particular, an axially forward region of foot valve 104 is embedded and locked axially within the rearward anvil end region of drill bit shaft 106. In particular, just over half of the axial length of foot valve 104 extends rearward from anvil end 117.

Casing 101 and distributor cylinder 121 define the internal chamber having an axially rearward region 111*a* and axially forward region 111*b*. Piston 103 is capable of reciprocating axially to shuttle within chamber regions 111*a*, 111*b*. In particular, a pressurised fluid is delivered to drill assembly 100 via a drill string (not shown) coupled to top sub 102. Distributor cylinder 121 and top sub 102 control the supply of the fluid to the chamber regions 111*a*, 111*b*. In particular, and as will be appreciated, with fluid supplied to the axially rearward region 111*a*, piston 103 is forced axially towards drill bit 105 such that the piston forward end 115 strikes anvil end 117 to provide the percussive drilling action to the cutting buttons 108. Fluid is then supplied to the forward cavity region 111*b* to force piston 103 axially rearward towards top sub 102. With piston 103 in the axially forwardmost position, foot valve 104 is mated within piston passageway 113 to isolate and close fluid communication between drill bit passageway 116 and cavity region 111*b*. As piston 103 is displaced axially rearward, piston end 115 clears foot valve end 119 to allow the pressurised fluid to flow within drill bit passageway 116 and to exit drill bit head 107 via flushing channels 120. Accordingly, the distributed supply of fluid to cavity regions 111*a*, 111*b* creates the rapid and reciprocating shuttling action of piston 103 that, in turn, due to the repeated mating contact with foot valve 104, provides a pulsing exhaust of pressurised fluid at the drill bit head 107 as part of the percussive drilling action.

Figure 2:
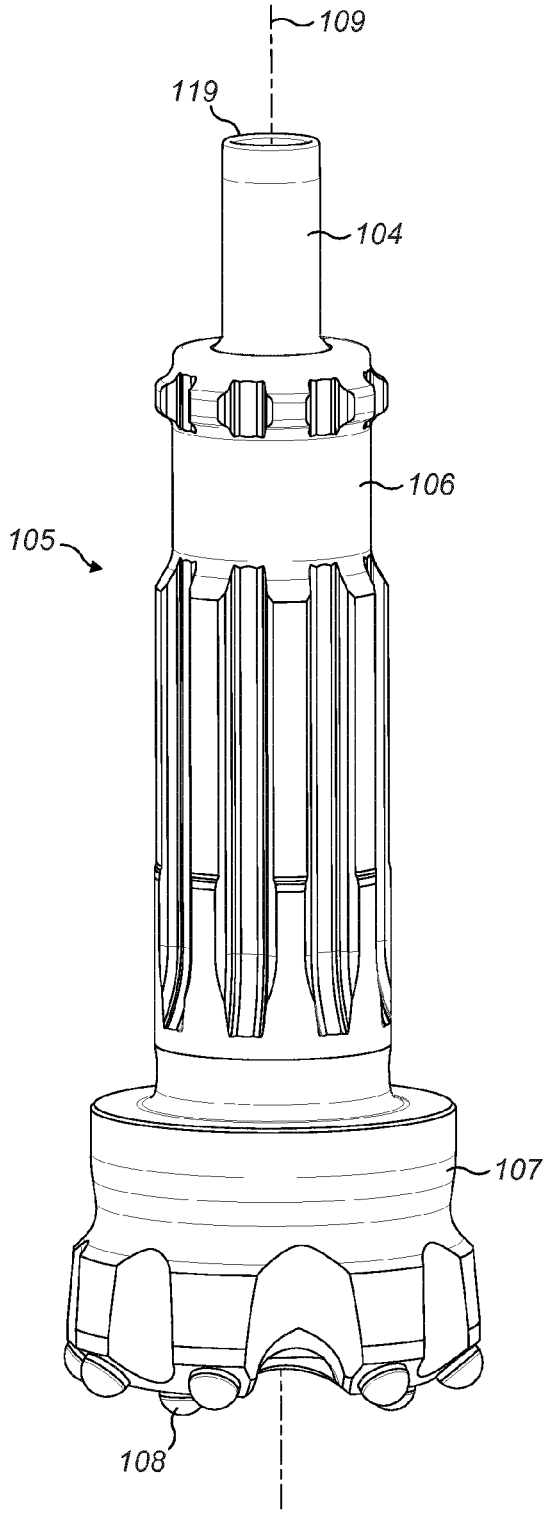
FIG. 2 is an external perspective view of the drill bit end of the assembly of FIG. 1.
Figure 3:
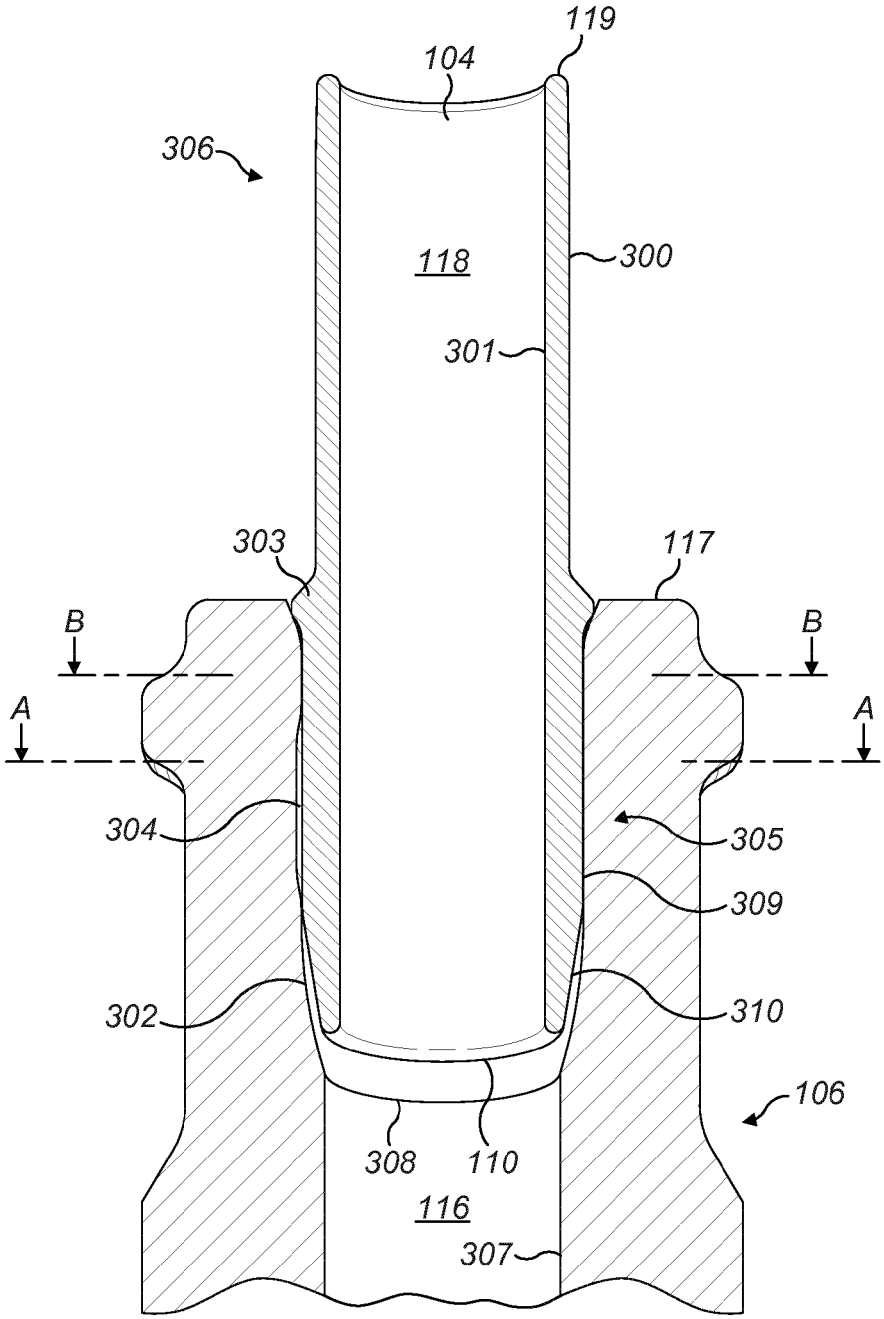
FIG. 3 is a cross sectional side view through an anvil end of the drill bit shaft and foot valve of FIG. 2.

Referring to FIGS. 2 and 3, foot valve 104 may be considered to comprise an axially rearward length section 306 and an axially forward length section 305, with section 305 comprising a larger outside diameter than section 306. A radially projecting annular collar 303 is positioned axially at the junction between sections 306, 305. Passageway 118 is defined by a substantially cylindrical inward facing surface 301 extending between rearward end 119 and forward end 110. Rearward length section 306 projects axially rearward from drill bit shaft anvil end 117 such that a radially outward facing valve surface 300 is exposed and is capable of sliding contact against and within the forwardmost end of piston passageway 113. A corresponding radially outward facing valve surface 309 is configured for positioning opposed to a radially inward facing surface 307 of drill bit shaft 106 that defines shaft passageway 116. In particular, an axially rearward region 302 of passageway 116 is radially enlarged to accommodate the larger outside diameter length section 305. When valve 104 is locked in position at the anvil end of shaft 106, the axially forwardmost valve end 110 is very closely axially co-located at an axially forwardmost end 308 of passageway region 302. The inside diameter of valve passageway 118 is substantially uniformed between ends 119, 110 such that the larger outside diameter of section 305 relative to section 306 is provided by a greater valve wall thickness at this section 305. Such a configuration is advantageous to provide both a friction-fit arrangement between valve 104 and drill bit shaft 106 and to withstand the stresses and stress concentrations at valve 104 during initial coupling, operational use and decoupling of valve 104 from shaft 106.

Figure 4:
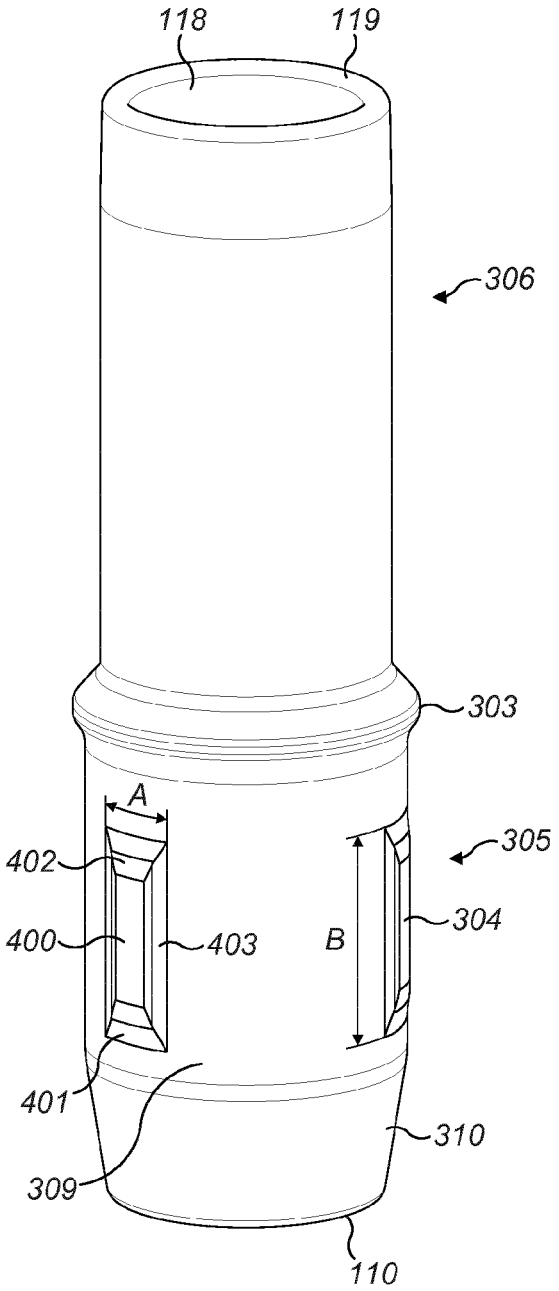
FIG. 4 is an external perspective view of the foot valve of FIG. 3.

The friction-fitting and axial locking of valve 104 at drill shaft 106 is also provided, in part, by a plurality of radially spaced lugs 304 that are distributed circumferentially (relative to axis 109) at and around forward length section 305. Referring to FIG. 4, each lug 304 is formed as a discrete raised hump at the radially outward facing surface 309 axially between collar 303 and forwardmost end 110. Each lug 304 comprises a generally rectangular shape profile and is defined by an axially rearward face 402, an axially forward face 401 and a pair of lengthwise side faces 403 that collectively terminate at their radially outermost ends in a common plateau face 400 that also comprises a generally rectangular shape profile. The forward, rearward and side faces, 401, 402, 403 are tapered such that each lug 304 is formed as a smooth raised lump.

Referring to FIG. 4, a circumferential length A of each lug 304 is less than a corresponding axial length B. In particular, valve 104 comprises three lugs 304 equally spaced apart in the circumferential direction around surface 309 such that the circumferential separation distance between lugs 304 is greater than the lug circumferential length A and axial length B.

Figure 5:
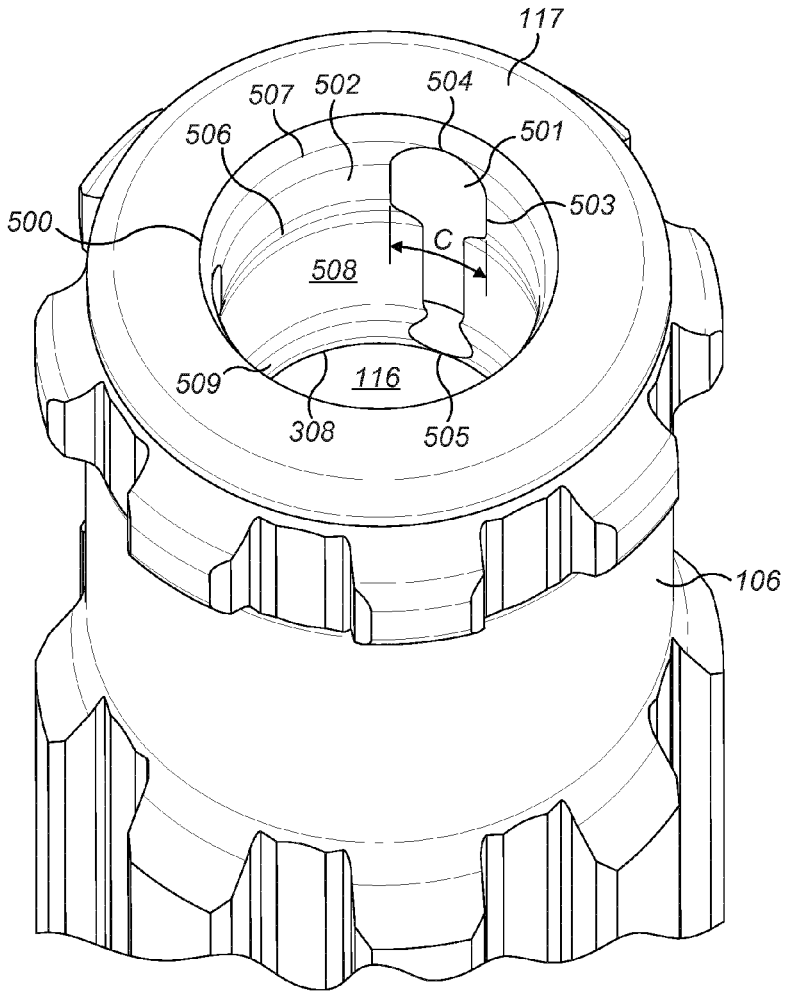
FIG. 5 is an external perspective view of the anvil end of the drill bit of FIG. 2.

Referring to FIG. 5, a plurality of radially extending shoulders 502 are distributed circumferentially around the inward facing surface 307 of the axially rearward passageway region 302. Each shoulder 502 projects radially inward from surface 307 and is equally spaced in a circumferential direction from neighbouring shoulders 502 by intermediate channels 501. Each channel 501 extends axially and comprises an axially rearward end 504, positioned approximately coaxially with anvil end 117, and an axially forward end 505 approximately co-located at region end 308. The circumferential ends 503 of each shoulder 502 are tapered radially such that each channel 501 comprises a smooth curved shape profile between shoulders 502. According to the specific embodiment, drill shaft 106 comprises three circumferentially spaced shoulders 502 and channels 501. Each shoulder 502 is defined axially by an axially rearward surface 507 and an axially forward surface 506. Each surface 506, 507 extends circumferentially between channels 501 and is tapered radially such that a radial thickness of each shoulder 502 increases gradually in the axial direction from above and below.

A circumferential length C of each channel 501 between the circumferential shoulder ends 503 is slightly greater than lug circumferential length A so as to allow each lug 304 to pass axially between adjacent shoulders 502 and to slide axially within a respective channel 501 during an initial coupling and subsequent decoupling of foot valve 104 at drill shaft 106.

Additionally, an axially forward portion 509 of region 302 is radially tapered to be generally conical and configured to mate with a tapered generally conical end region 310 of valve 104.

Figure 6:
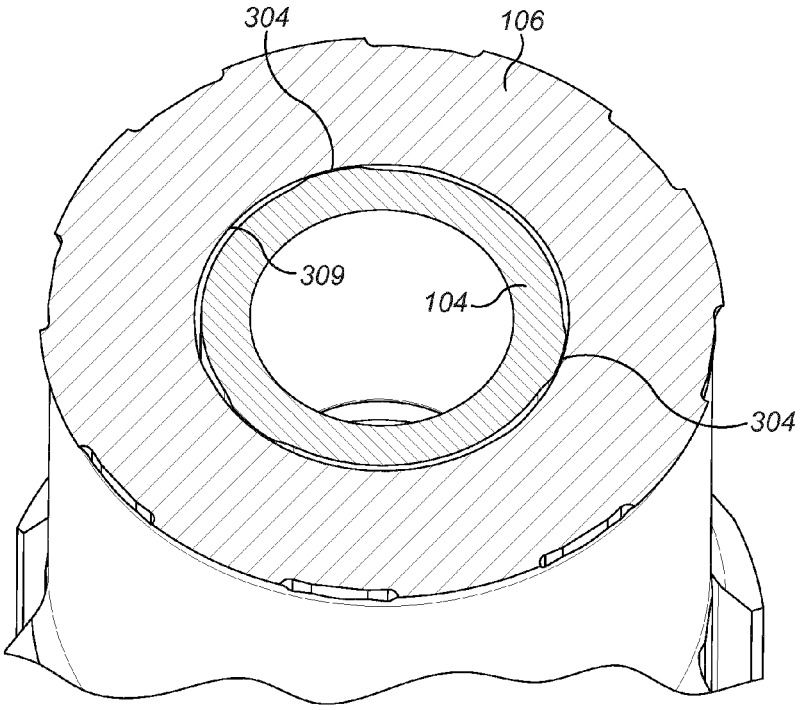
FIG. 6 is a cross section through A-A of FIG. 3.

FIG. 6 illustrates a cross section through A-A of FIG. 3. As shown, each lug 304 represents a radially outermost portion of valve length section 305 between collar 303 and forwardmost end 110. Accordingly, each lug 304 is positioned in close touching contact with the radially inward facing surface 309 of passageway 116. Section A-A corresponds to the axial region 508 axially beyond (or below) each shoulder 502 with valve 104 in a locked position at drill bit 105. In this position, each lug 304 is positioned to radially overlap a corresponding shoulder 502 that represents innermost region of passageway 116 at rearward region 302.

Figure 7:
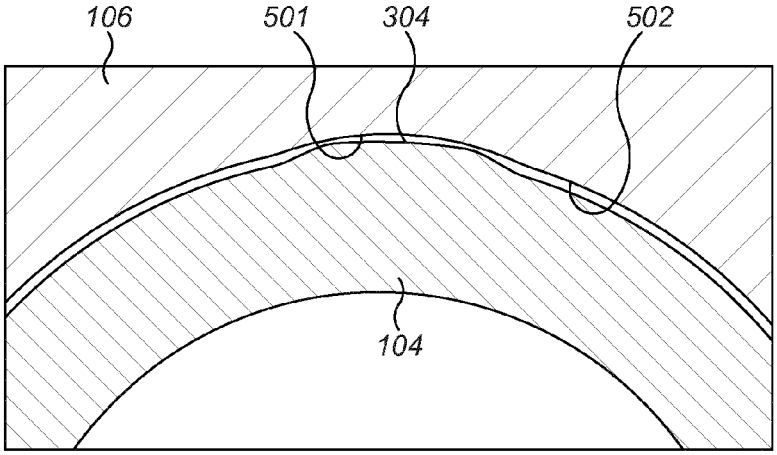
FIG. 7 is a partial cross section through B-B of FIG. 3 with the foot valve in position within the drill bit shaft passageway prior to rotational locking.
Figure 8:
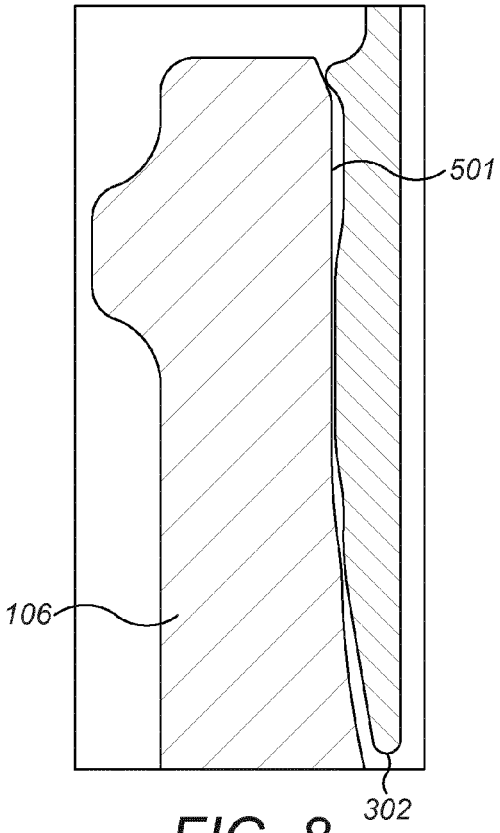
FIG. 8 is the corresponding axial cross section of FIG. 7 at the lock and abutment region between the foot valve and passageway of the drill bit shaft in the unlocked position.
Figure 9:
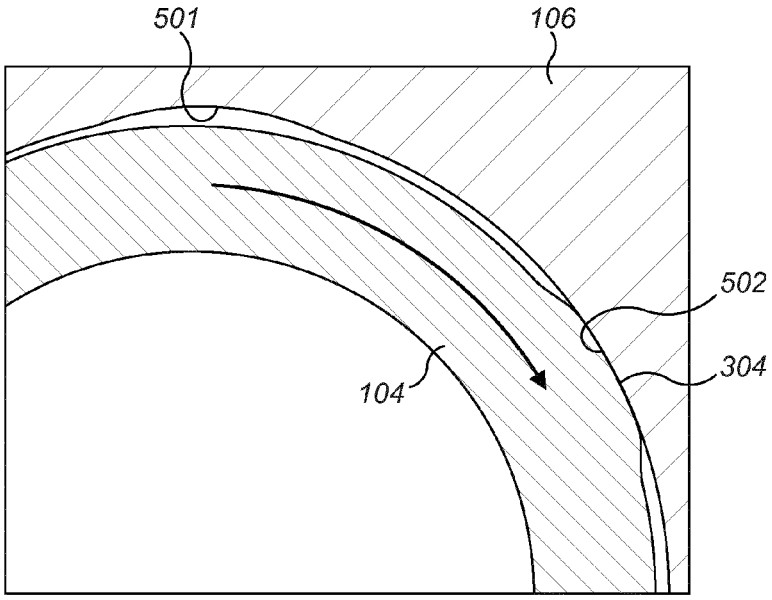
FIG. 9 is a partial cross section through B-B of FIG. 3 with the foot valve rotated within the drill bit shaft passageway to an axially locked position.
Figure 10:
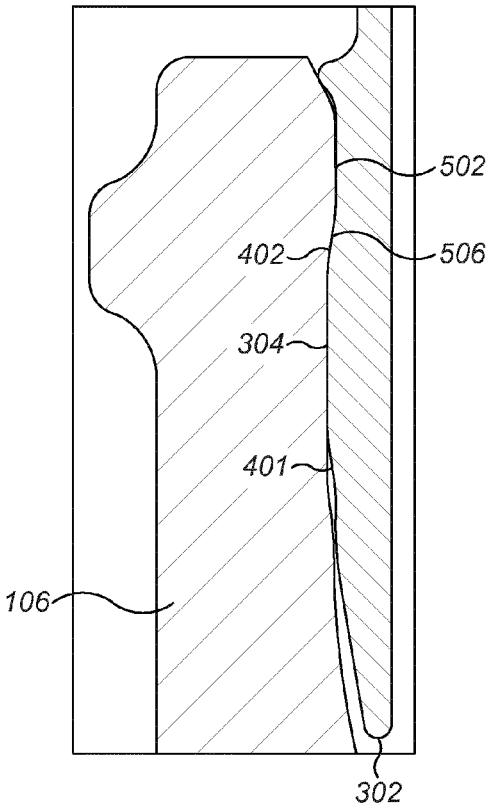
FIG. 10 is the corresponding axial cross section of FIG. 9 at the lock and abutment region between the foot valve and passageway of the drill bit shaft in the locked position.

Axial coupling and decoupling of valve 104 at drill shaft 106 is illustrated and described referring to FIGS. 7 and 8. With each lug 304 circumferentially aligned with a respective channel 501, valve 104 may be displaced axially at drill shaft 106. The axial locking of valve 104 at shaft 106 is illustrated and described with reference to FIGS. 9 and 10. In particular, valve 104 is rotated about axis 109 to displace lugs 304 circumferentially relative to shoulders 502 and channels 501. In particular, each lug rearward face 402 is capable of being rotated into contact with shoulder face 506 to provide a friction-fitting of valve 104 within passageway 116. Due to the radial projection of each lug 304 and each shoulder 502, the lugs 304 and shoulders 502 overlap radially as illustrated in FIG. 10 to prevent valve 104 being withdrawn axially from drill shaft 106. In particular, axial movement is prevented by the abutment contacts between the three pairs of respective surfaces 402, 506.

The present configuration is advantageous to allow initial coupling of valve 104 at drill shaft 106 by simply pressing the valve 104 into passageway 116 by hand. Valve 104 may then be locked or unlocked axially via a convenient rotation about axis 109 to engage lugs 304 into contact with the axial end surfaces 506 of shoulders 502. The present assembly may be conveniently coupled and decoupled without the need for specific swaging apparatus (mechanical, hydraulic or pneumatic presses) and may be manipulated on-site by operational personnel by hand and/or using common standard tools.

The invention claimed is:

1. A down-the-hole hammer drill bit assembly comprising:

a drill bit having a forward cutting end, a rearward anvil end and an internal passageway extending along a longitudinal axis of the assembly from the anvil end towards the cutting end;

a foot valve seated partially within the passageway to extend axially from the anvil end; and complementary abutment regions provided respectively at a radially inward facing surface of the passageway and at a radially outward facing surface of the foot valve, the abutment regions being configured to abut one another and axially lock the foot valve to the drill bit, the abutment regions including a plurality of radially projecting lugs spaced apart in a circumferential direction around the axis and a plurality of radially extending shoulders spaced apart in a circumferential direction around the axis, a circumferential separation distance between the shoulders at least equal to or greater than a circumferential length of the lugs to allow the lugs to pass axially between the shoulders without substantially deforming the foot valve radially, an axially rearward end of each lug being tapered radially to provide an abutment contact surface and an axially forward end of each shoulder is tapered radially to provide an abutment contact surface, wherein a radial length of the lugs and shoulders is configured such that when the lugs are positioned axially beyond the shoulders the abutment contact surfaces of the lugs and shoulders mate together to overlap radially within the passageway to provide friction fit regions that axially lock and inhibit independent rotation of the foot valve at the drill bit.

2. The assembly as claimed in claim 1, comprising three lugs and three shoulders.

3. The assembly as claimed in claim 1, wherein each lug is formed as a discrete raised bump.

4. The assembly as claimed in claim 1, wherein the abutment contact surface of each lug is tapered radially to provide an inclined contact surface and the abutment contact surface of each shoulder is tapered radially to provide a declined contact surface such that the inclined and declined surfaces are complementary to mate together via overlapping contact.

5. The assembly as claimed in claim 4, wherein each lug and each shoulder is defined, in part, by a pair of respective lengthwise side surfaces tapered radially such that each lug and each shoulder is formed by a smooth transition with the respective surface of the foot valve and the passageway.

6. The assembly as claimed in claim 5, wherein the lugs and shoulders are positioned axially closest to the anvil end relative to the cutting end.

7. The assembly as claimed in claim 1, wherein a region of the radially inward facing surface of the passageway and/or the radially outward facing surface of the foot valve is radially tapered in the circumferential direction to friction fit the foot valve at the drill bit on rotation of the foot valve at the drill bit.

8. The assembly as claimed in claim 1, wherein the foot valve is a plastic material and the drill bit is a metal or metal alloy material.

9. The assembly as claimed in claim 1, wherein the lugs project radially outward from the radially outward facing surface of the foot valve and the shoulders extend radially inward from the radially inward facing surface of the passageway.

10. The assembly as claimed in claim wherein within a lengthwise region of the foot valve configured to be positioned within the passageway, the lugs form a radially outermost part of the foot valve; and within a lengthwise region of the drill bit configured for mating opposed to the foot valve, the shoulders form a radially innermost part of the passageway.

11. The assembly as claimed in claim 10, wherein the shoulders are positioned radially inward relative to a radial position of an opening of the passageway located at the anvil end.

12. The assembly as claimed in claim 11, wherein the foot valve includes a first length section and a second length section, the second length section having a larger outside diameter relative to the first length section, the lugs being positioned within the second length section.

13. The assembly as claimed in claim 12, further comprising an annular collar extending radially outward beyond the second length section and positioned axially at the junction between the first and second length sections.

* * * * *